US008016538B2

(12) United States Patent
Monti

(10) Patent No.: US 8,016,538 B2
(45) Date of Patent: Sep. 13, 2011

(54) SYSTEM FOR WEIGHING CONTAINERS

(75) Inventor: Giuseppe Monti, Pianoro (IT)

(73) Assignee: Open Business Exchange Limited, London (GB)

( * ) Notice: Subject to any disclaimer, the term of this patent is extended or adjusted under 35 U.S.C. 154(b) by 759 days.

(21) Appl. No.: 12/110,382

(22) Filed: Apr. 28, 2008

(65) Prior Publication Data

US 2008/0273946 A1 Nov. 6, 2008

(30) Foreign Application Priority Data

May 3, 2007 (IT) ..... BO2007A0318

(51) Int. Cl.

| | |
|---|---|
| ***B65H 1/00*** | (2006.01) |
| ***B65G 69/00*** | (2006.01) |
| ***B65B 57/02*** | (2006.01) |
| ***G01G 13/00*** | (2006.01) |

(52) U.S. Cl. ..... 414/222.13; 414/21; 414/744.5; 198/468.2; 198/959; 141/168; 141/83; 177/52

(58) Field of Classification Search ..... 177/145, 177/52, 54–56; 198/346.2, 468.2, 959; 414/21, 414/222.13, 744.1–744.2, 744.5–744.6, 917; 901/7, 39

See application file for complete search history.

(56) References Cited

U.S. PATENT DOCUMENTS

| | | | | |
|---|---|---|---|---|
| 5,176,241 | A * | 1/1993 | Schaltegger | 198/346.2 |
| 5,236,337 | A * | 8/1993 | Kikuchi et al. | 177/52 |
| 6,293,746 | B1 * | 9/2001 | Ogawa et al. | 414/744.5 |
| 6,705,177 | B2 * | 3/2004 | Okuno et al. | 74/490.01 |
| 7,503,353 | B2 * | 3/2009 | Monte | 141/1 |
| 2005/0217053 | A1 * | 10/2005 | Kim et al. | 15/250.21 |
| 2006/0076078 | A1 * | 4/2006 | Monti | 141/83 |

FOREIGN PATENT DOCUMENTS

WO WO 2007003407 A1 * 1/2007

* cited by examiner

*Primary Examiner* — Gregory W Adams

(74) *Attorney, Agent, or Firm* — William J. Sapone; Coleman Sudol Sapone P.C.

(57) ABSTRACT

The station for weighing containers comprises a line for transporting containers to be filled with a predetermined product, a zone for dosing and filling the containers with the product, a first transferring organ for picking up and transferring an individual empty container to a weighing organ, a second transferring organ for picking up and transferring the container to the weighing organ after filling. The transferring organs respectively comprise an oscillating arm which is activated with alternating motion between a pick-up and release position of the container to be weighed in proximity of the transport line and a position of release and pick-up of the container nearby the weighing organ. The oscillating arm bears a rotating head provided with gripping organs which is rotated angularly in opposite directions by a relative motor, in a suitable phase relation with the motion of the oscillating arm, in order to transfer the container to be weighed from the transport line to the weighing organ and vice versa.

14 Claims, 11 Drawing Sheets

SYSTEM FOR WEIGHING CONTAINERS

BACKGROUND OF THE INVENTION

The invention concerns a station for weighing containers, such as vials and the like, destined for use in a line for filling the containers with liquids or powders.

Machines are known which fill vials with a predetermined liquid or powder product. These machines generally exhibit a filling line along which the empty vials advance step-wise or continuously, passing by a dosing station where a dosed quantity of the predetermined product is introduced into the vials.

In these filling lines, both the weight of the product introduced into the containers, and the overall weight of the filled containers need to be measured very accurately. This operation is performed not only to identify and discard any containers which do not conform to specifications, but also to regulate the amount of content introduced into the containers with greater accuracy, possibly using suitable feedback control devices.

Traditionally, sample weighing systems, commonly known as statistical weighing systems, are used for this purpose, which measure the weight of selected containers, picked up at predefined time intervals from the transport line of the containers. These systems enable weighing operations to be effected without slowing down the transport line, and thus without interfering with plant production capacity.

In particular, statistical weighing systems are known which use two scales, destined respectively to determine the tare and the gross weight. Each container to be weighed is picked up from the line before filling by suitable gripping means and transferred to the first scales, where the container is weighed. Subsequently, the container is repositioned on the transport line and filled, after which it is picked up by further pick-up means and transferred to the second scales, where it is weighed a second time. The difference between the two values is the net weight of the contents introduced into the container.

International patent application WO 2007/003407 illustrates an apparatus for statistical weighing of containers. This apparatus comprises a transport line of the containers, a first transferring organ for picking up and transferring an individual container to weighing organs and a second transferring organ for picking up the weighed container from the weighing organs and transferring it back to the transport line. The transferring and weighing organs are duplicated, since both the tare and the gross weight must be determined; in addition, two scales must be used. More specifically, the transferring organs comprise a series of supports which rotate about reciprocally parallel axes of rotation which are perpendicular to the plane in which the containers travel; these transferring organs bear pincer-like gripping organs which grip the containers.

However the drawback with the described system is that it does not deliver a high level of measurement accuracy, essentially because of propagation of instrumental errors of the two scales when calculating the difference between the measured values. This drawback is even more significant when the weights are small and great accuracy is required, as is the case when packing pharmaceutical products.

Also known is a statistical weighing method, as illustrated in document EP 1 677 484 belonging to the present Applicant.

Prior art statistical weighing systems are however rather complicated to construct and operate and do not always optimally meet the speed and precision requirements of current automatic machines.

SUMMARY OF THE INVENTION

The aim of this invention is to solve the problem outlined above, by providing an operating station which makes it possible optimally to achieve statistical weighing of the containers on lines for filling the containers with dosed quantities of liquid or powder products.

A further aim of the invention is to provide a weighing station which uses only one weighing organ of simple constructional and functional conception, and which is reliable in operation, versatile in use and relatively inexpensive.

A further aim of the invention is to provide a weighing station for integration into known filling lines without requiring substantial modifications to the machine's original structure.

The above aims are achieved by means of a station for weighing containers provided in an apparatus for filling containers, which apparatus comprises a transport line of the containers to be filled with a predetermined product, and a dosing and filling zone for dosing and filling the containers with the product along the transport line, the station being characterized in that it comprises one single organ for weighing the containers which are arranged in proximity of the transport line; a first transferring organ for picking up an individual empty container from the line, for transferring the container to the weighing organ and, after weighing the container, returning the container to the line; a second transferring organ, which is activated in a phase relation with activation of the first transferring organ to pick up a filled container downstream of the dosing and filling zone of the containers, a tare weight of the container having been determined previously by a combined action of the first transferring organ and the weighing organ, and transfer the container to the weighing organ and, after weighing the container, relocate the container on the line.

BRIEF DESCRIPTION OF THE DRAWINGS

The characteristics of the invention are illustrated below, with particular reference to the appended tables of drawings in which:

FIGS. 2A-11A illustrate corresponding enlarged details X, Y of the weighing station.

DESCRIPTION OF THE PREFERRED EMBODIMENTS

Figure 1:
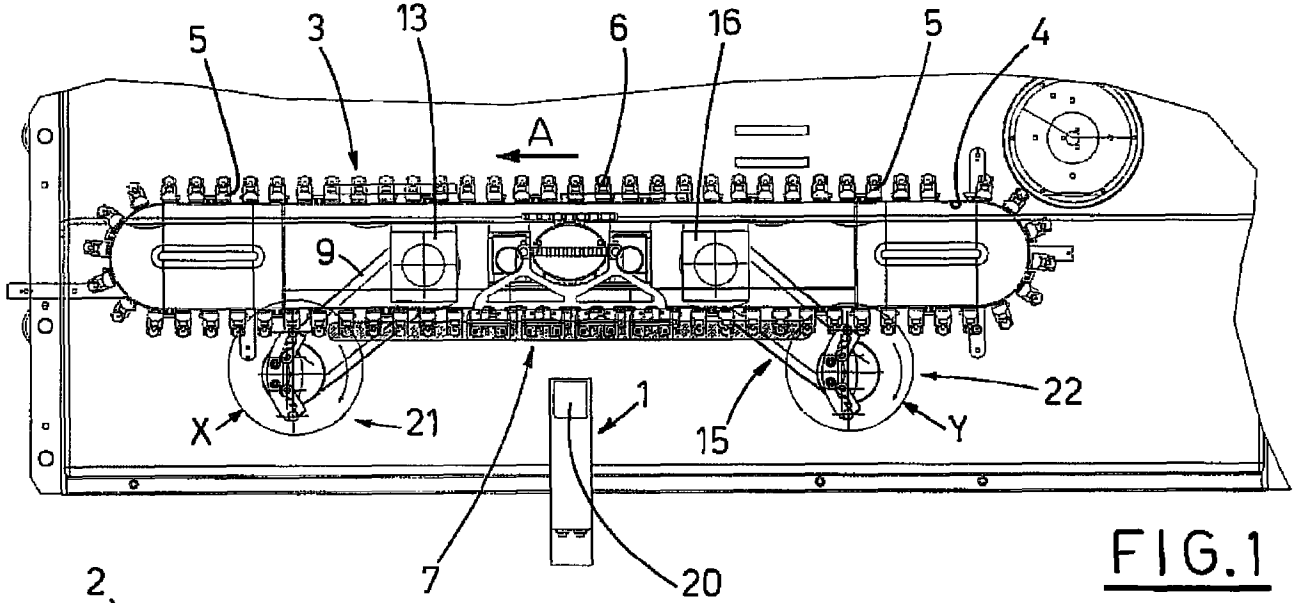
FIG. 1 illustrates a plan view of a line for automatically filling containers comprising the weighing station of the invention.

With particular reference to the figures, the number 1 denotes in its entirety the station for statistical weighing of the containers 2, for example vials.

The station 1 is integrated into a transport line 3 of a machine for automatically filling containers 2 with liquids or powders. In a substantially known way, the filling line 3 comprises a transporter organ 4 of the belt or cogged belt type, performing a ring-wound trajectory in the direction indicated by the arrow A, and a plurality of support organs 5, constrained to the transporter 4 at regularly distanced positions. Each support 5 receives and transports an individual container 2 and exhibits for this purpose jaw-type hooking means 6 which act for example by elastic deformation. Known dosing means operate in a zone 7 for filling the containers 2, arranged along the transporter line 3.

The weighing station 1 exhibits a first transferring organ 21, situated upstream of the dosing and filling zone 7, comprising a first rotating head 8, located at the end of a first oscillating arm 9. The first oscillating arm 9 is rotatably constrained at the opposite end to a support 13 which enables the arm 9 to rotate in a horizontal plane. The support 13 is provided with a motor, not illustrated, to power this movement and is situated along the line 3, upstream of the dosing and filling zone 7, in the advancement direction of the containers 2.

The first rotating head 8 (FIG. 1A) comprises a disc-shaped support 10, rotatably constrained to the first oscillating arm 9; an arc-shaped element 11, solidly constrained to the disc 10, which gives rise to two fixed prongs 11*a*, 11*b* projecting externally beyond the disc 10, which cooperate with two corresponding mobile prongs 12*a*, 12*b*, hinged to the disc 10 by means of a relative pin 12*c* which allows rotation in a plane which is parallel to the disc 10. The fixed prong 11*a*, together with the relative mobile prong 12*a*, give rise to a first pincer-like gripping organ 31*a*; similarly the remaining fixed prong 11*b* and mobile prong 12*b*, give rise to a second pincer-like gripping organ 31*b*, the shape of which is the mirror image of the first.

Each of the pincer-like gripping organs 31*a*, 31*b*, when activated by the relative actuator organ in various stages better described below, grips an empty container 2 to enable the container to be transferred to weighing scales 20. The rotatable disc 10 is in turn angularly rotated, as explained below, by a motor organ which is not illustrated.

Downstream of the dosing and filling zone 7, the weighing station 1 exhibits a second transferring organ 22 comprising a second rotating head 14, located at the end of a second oscillating arm 15. The second oscillating arm 15 is rotatably constrained at the opposite end to a support 16, in turn provided with a suitable motor, which causes the second oscillating arm 15 to rotate in a horizontal plane. The support 16 is situated along the line 3 downstream of the dosing and filling station 7.

The second rotating head 14 (FIG. 1B) in turn comprises a disc-shaped support 17, rotatably constrained to the second oscillating arm 15; an arc-shaped element 18, solidly constrained to the disc 17, giving rise to two fixed prongs 18*a*, 18*b*, projecting externally beyond the disc 17, and two mobile prongs 19*a*, 19*b*, constrained to the disc 17 by means of a pin 19*c* which allows rotation in a plane which is parallel to the disc 17. Similarly to the first rotating head 8, also in this case the fixed prongs 18*a*, 19*a* respectively define, in cooperation with the relative mobile prongs 18*b*, 19*b*, further third and fourth pincer-like gripping organs 32*a*, 32*b* which are the mirror image of each other.

Each of the further pincer-like gripping organs 32*a*, 32*b*, in turn powered by a relative actuator organ, grasps the filled container 2 in different stages described below, thus enabling transfer of the filled container 2 to the scales 20 and then back to the transport line 3. The rotating disc 17 is in turn angularly rotated, as described below, by a motor (not illustrated).

The station for statistical weighing of the containers functions as follows.

In an initial operating stage (FIGS. 1 and 1A) the first oscillating arm 9 moves to a position where the first rotating head 8 is as close as possible to the transport line 3, upstream of the dosing and filling zone 7. The first pincer-like gripping organ 31*a*, formed by the prongs 11*a*, 12*a*, thus moves to a position which is suitable for grasping a still-empty container 2 and picking up the container 2 from the relative support 5. Pick-up of the container 2 is determined by angularly rotating the rotatable disc 10, in the direction indicated by the letter B.

Figure 1B:
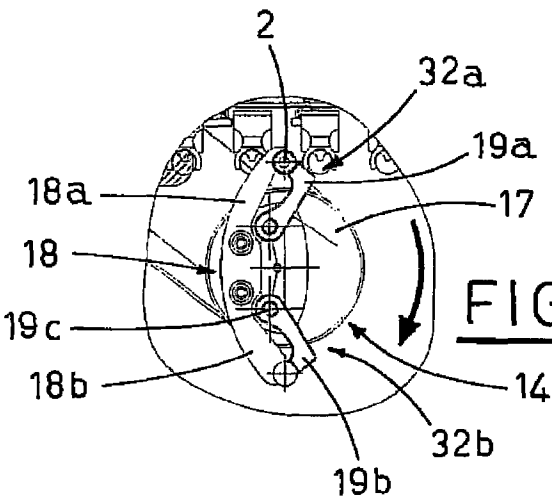
FIGS. 1A and 1B respectively illustrate an enlarged detail, X, Y of the weighing station.

Note that as explained below, during the same stage, the rotating head 14 of the second transferring organ 22 is already situated in the appropriate portion for picking up a filled container 2 for weighing from the transport line 3 (FIG. 1B).

Figure 2:
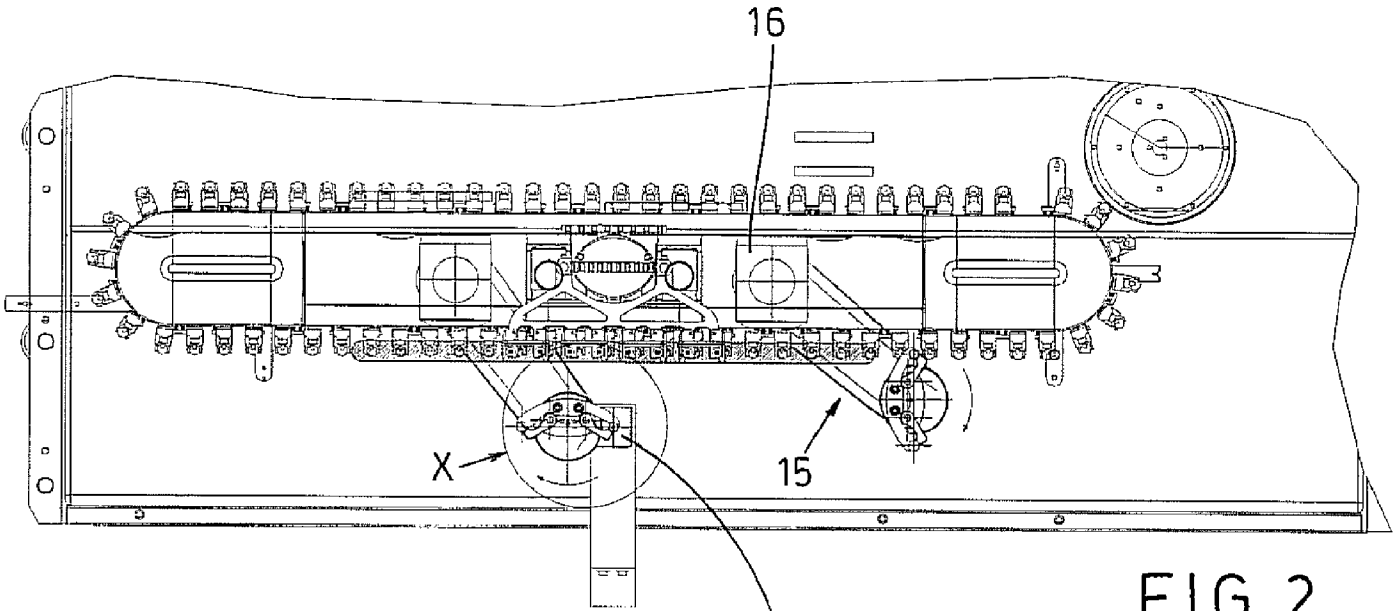
FIGS. 2-11 illustrate the plan view of the filling station of containers in successive operating stages.
Figure 2A:
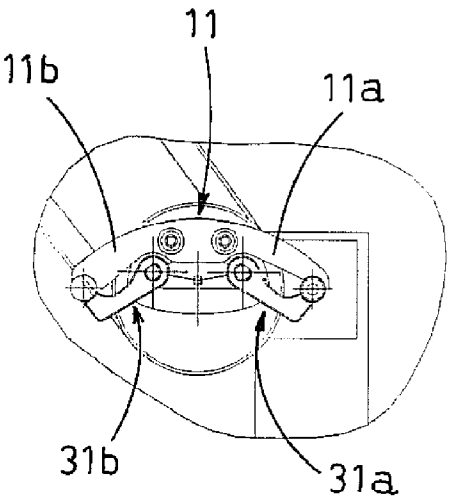

Once the container 2 has been grasped, the arm 9 oscillates, rotating on the support 13, and moves its free end towards to the scales 20 (FIG. 2). In particular, the oscillating arm 9 moves into a position in order that the first rotating head 8 superposes the plate of the scales 20 for releasing the empty container 2 to be weighed. In this stage, the first rotating head 8 is substantially rotated clockwise by 90°, relative to the pick-up position of the container from the transport line 3 (FIG. 2A).

Figure 3:
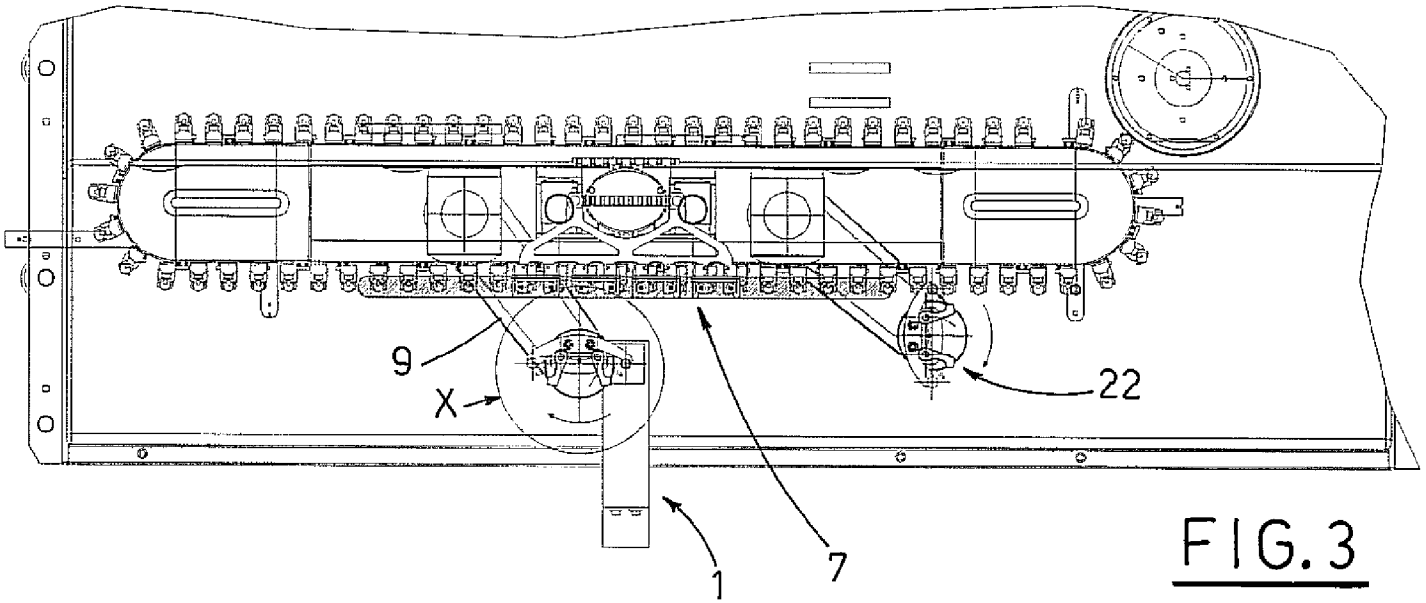

Release of the container 2 onto the plate of the scales 20 (FIGS. 3, 3A) is determined by the opening of the mobile prong 12*a* of the first pincer-like gripping organ 31*a*. At the same time the mobile prong 12*b* of the second pincer-like gripping organ 31*b* is also opened.

Figure 4:
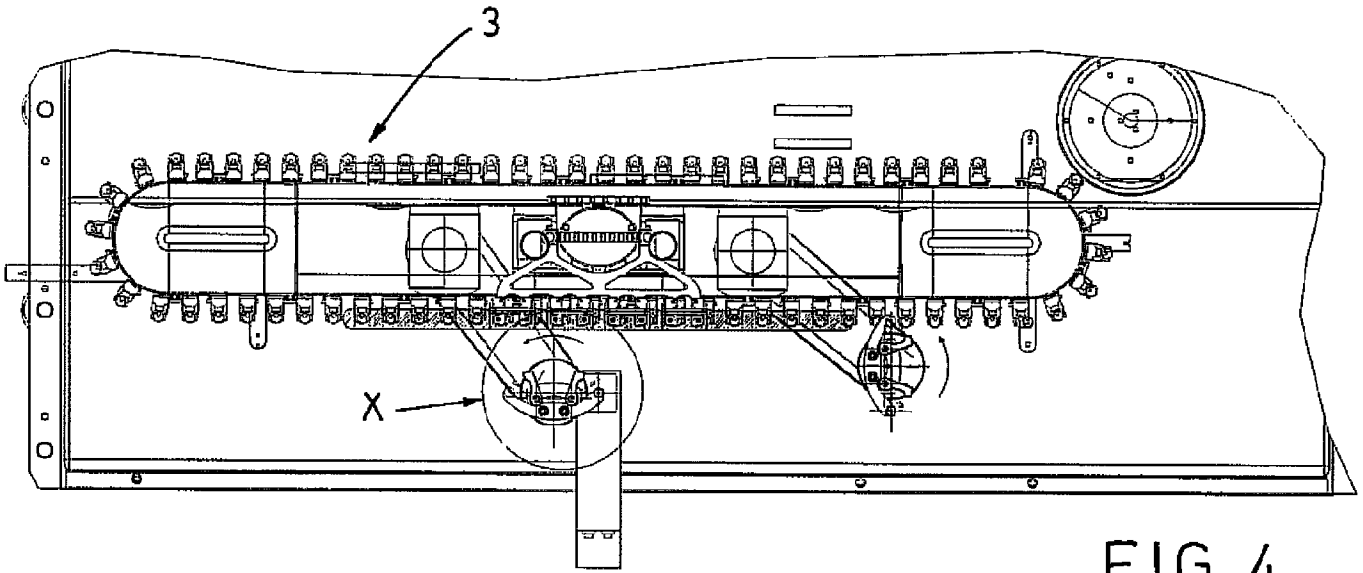
Figure 4A:
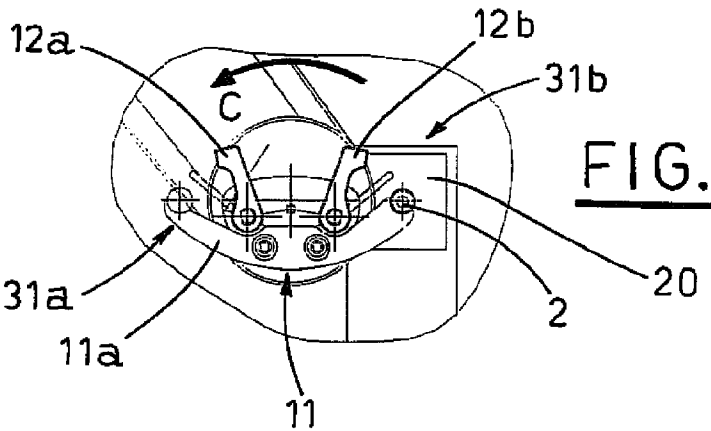

Immediately afterwards the rotating head 8 is rotated in the opposite direction C (FIGS. 4, 4A) by an angle of 180°; during this time interval, the empty container 2 is on the scales 20, is completely free, and its tare weight can be determined.

Figure 5:
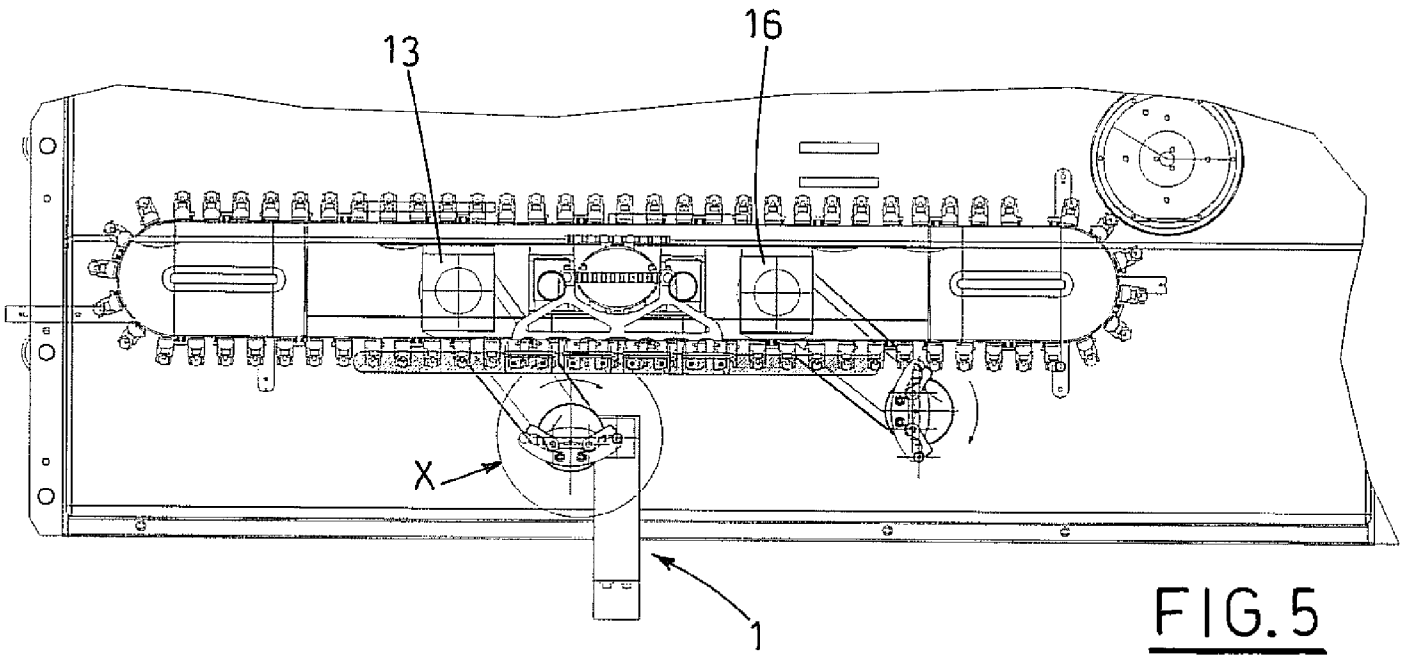
Figure 5A:
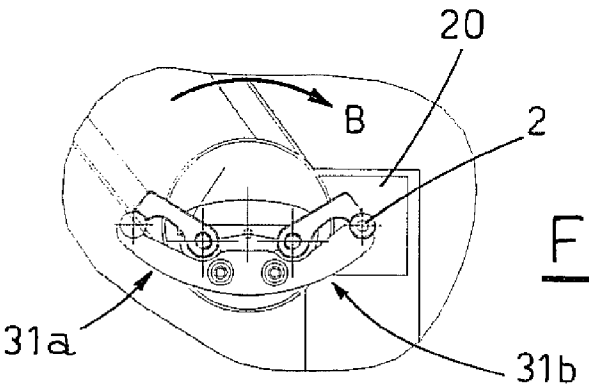

When the rotation is complete, the second pincer-like gripping organ 31*b* is near the container 2 on the scales 20, in a position suited to grasping the container 2 by closing the relative mobile prong 12*b* (FIGS. 5A, 5B). The mobile prong 12*a* of the first pincer-like gripping organ 31*a* is also closed.

Figure 6:
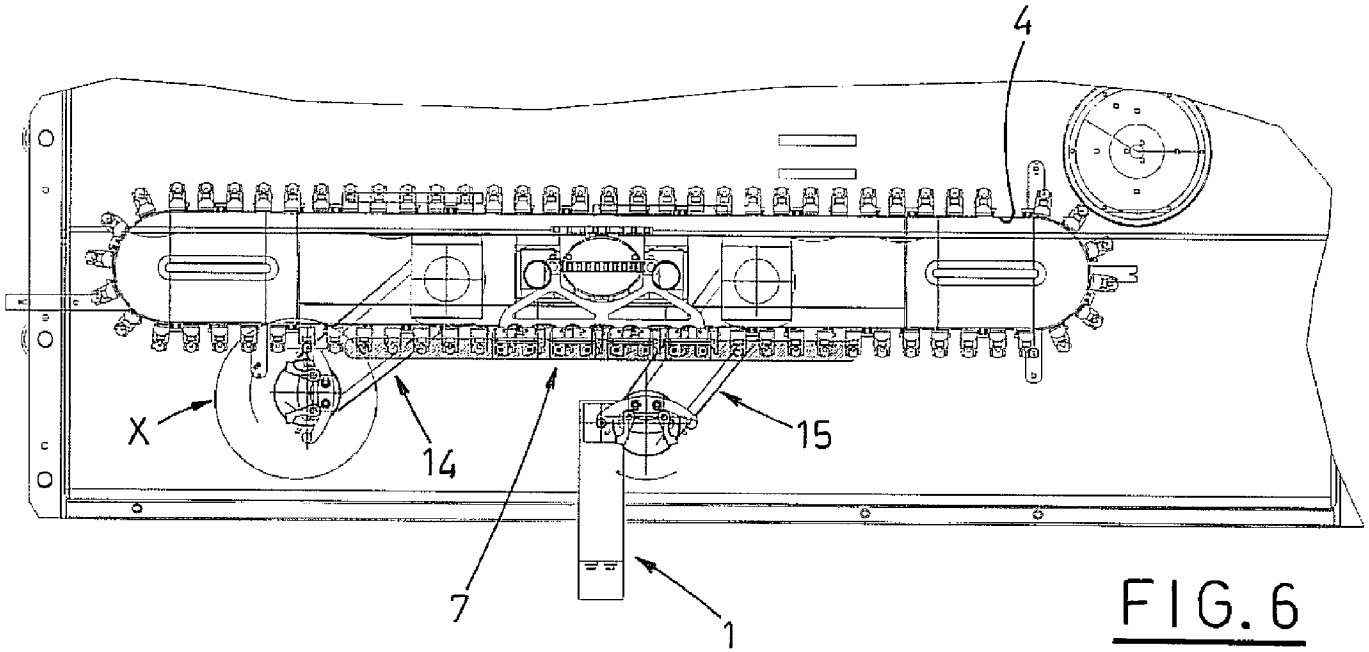
Figure 6A:
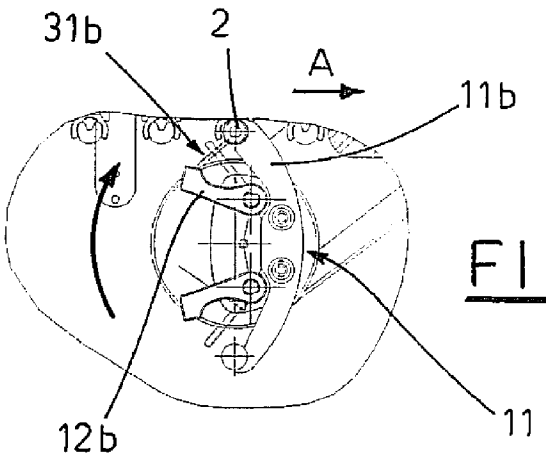

Next, the oscillating arm 9 is angularly rotated in a returning direction (FIGS. 6A, 6B), thus moving once again to a position nearby the transport line 3; at the same time, the rotating head 8 performs a rotation of 270° in the direction indicated by the arrow B and thus the weighed container 2 is relocated in a suitable free and ready support 5.

Note especially that the abovementioned rotation of the rotating head 8 in the direction B by an angle of 270° also has the effect of inverting the orientation of the concavity of the arc-shaped element 11 relative to the direction of advancement of the vials 2, thus determining optimal interaction of the pincer-like organ with the transport line. In fact, during reintroduction of the weighed container 2, while the second pincer-like gripping organ 31*b* is acting, the relative fixed prong 11*b* is situated in front of the container 2, in the direction of advancement A of the container 2.

The opening of the relative mobile prong 12*b* (FIG. 6A) and the rotation of the head 8 in direction B, i.e. equal to advancement direction A, mean that the second gripping organ 31*b* does not interfere with the container 2 just reintroduced into the relative support 5.

As the rotation of the head 8 continues through a further 180° in direction B the situation illustrated in FIG. 1A is reached again, and the first gripping organ 31*a* is ready to perform a new operation of picking up an empty container 2 to be weighed from the transport line 3.

Figure 1A:
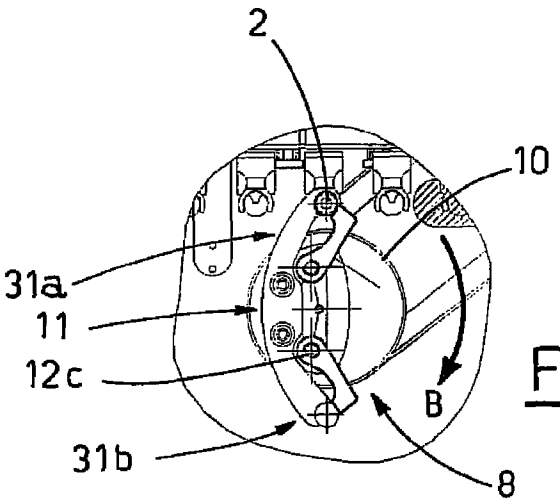

During this stage of picking up a container 2 for weighing, the fixed prong 11*a* is situated behind the container 2, in the direction of advancement A of the container 2 (see FIG. 1A). The rotation of the head 8 in direction B, in the same direction as advancement A, results in the fixed prong 11*a* pushing against the container 2, thus favoring exit of the container 2 from the relative support 5.

Figure 3A:
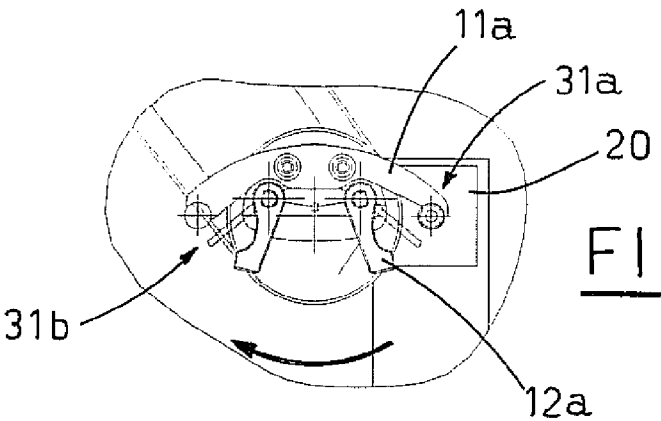

Also worthy of note is that when the gripping organs 31*a*, 31*b* are open, the mobile prongs 12*a*, 12*b* hinged on the disc 10 move to a disengaged position contained substantially within the peripheral dimensions of the disc 10 (see for example FIG. 3A). Therefore in this disengaged position, the mobile prongs 12*a*, 12*b* are of no hindrance to the correct pick-up of the container 2 from, and reintroduction of the container 2 to, the transport line 3. In particular, during the pick-up stage, the disengaged position of the mobile prongs

12*a*, 12*b* makes it possible to pass over the container 2 still arranged in the support organ 5, thus avoiding interference with the container 2.

Similarly, at the end of the relocation stage, the disengaged position of the mobile prongs 12*a*, 12*b* permits inversion of the direction of rotation of the gripping organ, also in this case avoiding interference with the container 2.

The same characteristic allows rotation by 180° in the direction C to be performed (FIGS. 4, 4A) when the rotating head 8 is at the scales 20, without interfering with the vial released onto the scales 20.

The weighed container 2 thus traverses the filling zone 7, where the weighed container 2 is filled with a dosed quantity of the predetermined product, and is subsequently picked up by the second transferring organ 22 for determination of the gross weight.

To this aim the second oscillating arm 15 moves, as previously described, to a position with the second rotating head 14 at the transport line 3 downstream of the dosing and filling station 7, in order to pick up the filled container 2 from the support 5 by means of the third gripping organ 32*a* formed by the prongs 18*a*, 19*a* (see FIGS. 1, 1B).

Figure 7:
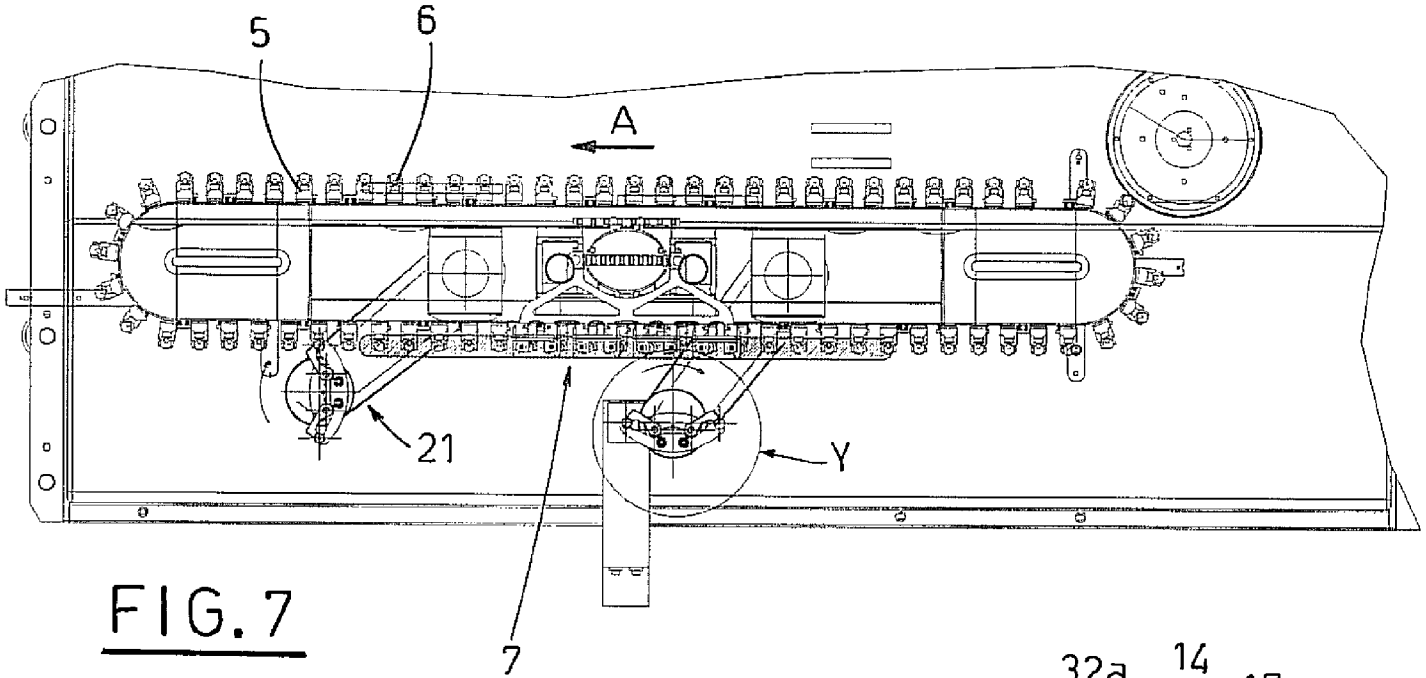
Figure 7A:
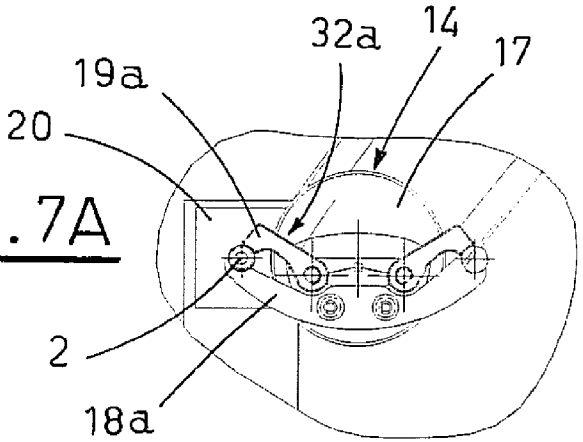

The filled container 2 is then transferred to the scales 20, in an operating sequence which is substantially similar to that already described for the empty container. At the end of this transfer stage (FIGS. 7, 7A), the second oscillating arm 15 moves to a position with the second rotating head 14 above the plate of the scales 20, in a suitable phase relation with the angular rotation of the rotating head 14 by an angle of 90°.

Figure 8:
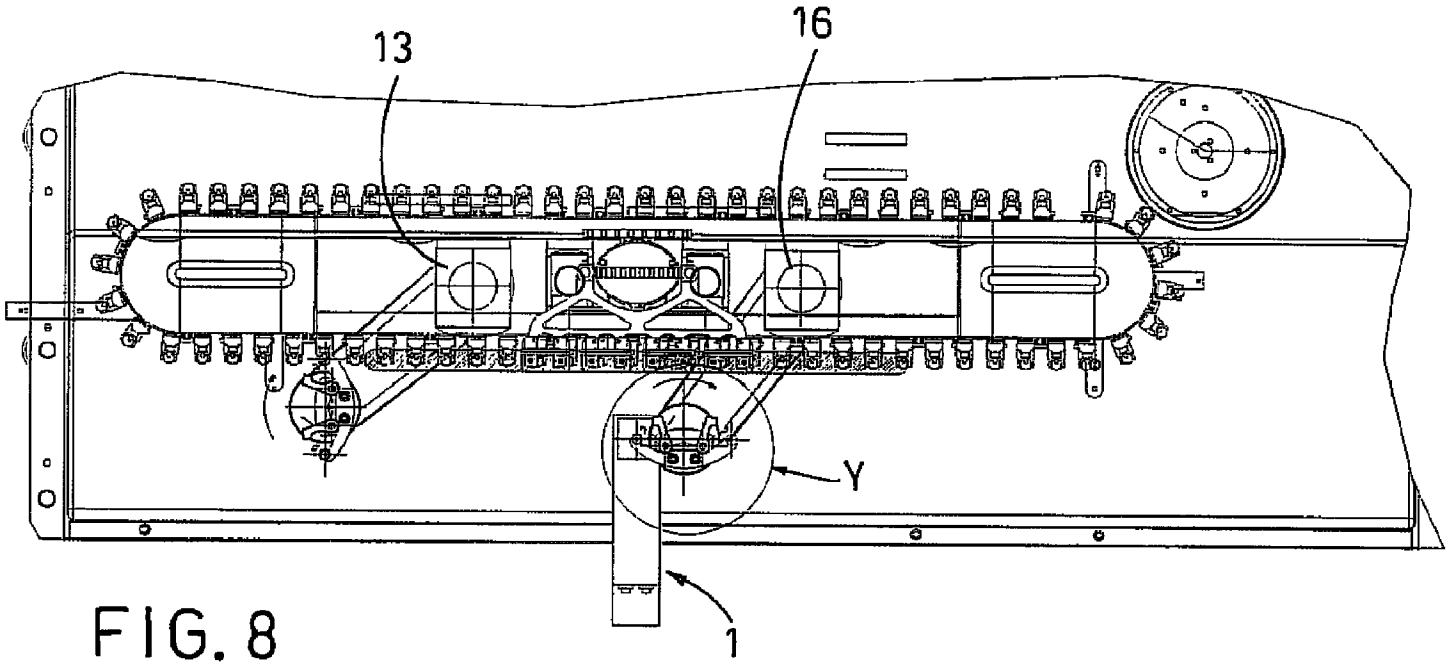
Figure 8A:
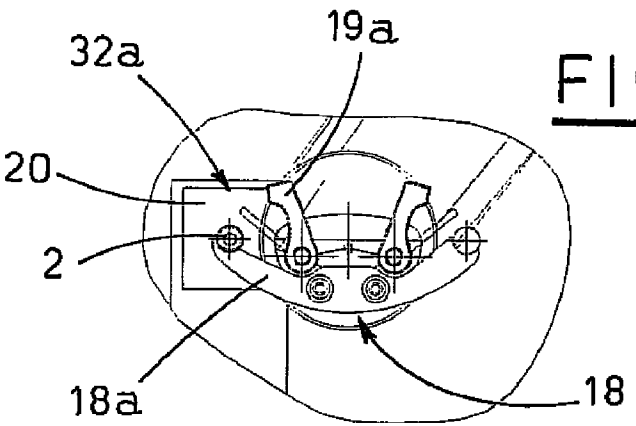

Then the mobile prong 18A of the third gripping organ 32*a* is opened (FIGS. 8, 8A) in order to release the container 2 onto the scales 20, thus allowing the gross weight to be determined; at the same time the mobile prong 18*b* of the fourth pincer-like gripping organ 32*b* is also opened.

Figure 9:
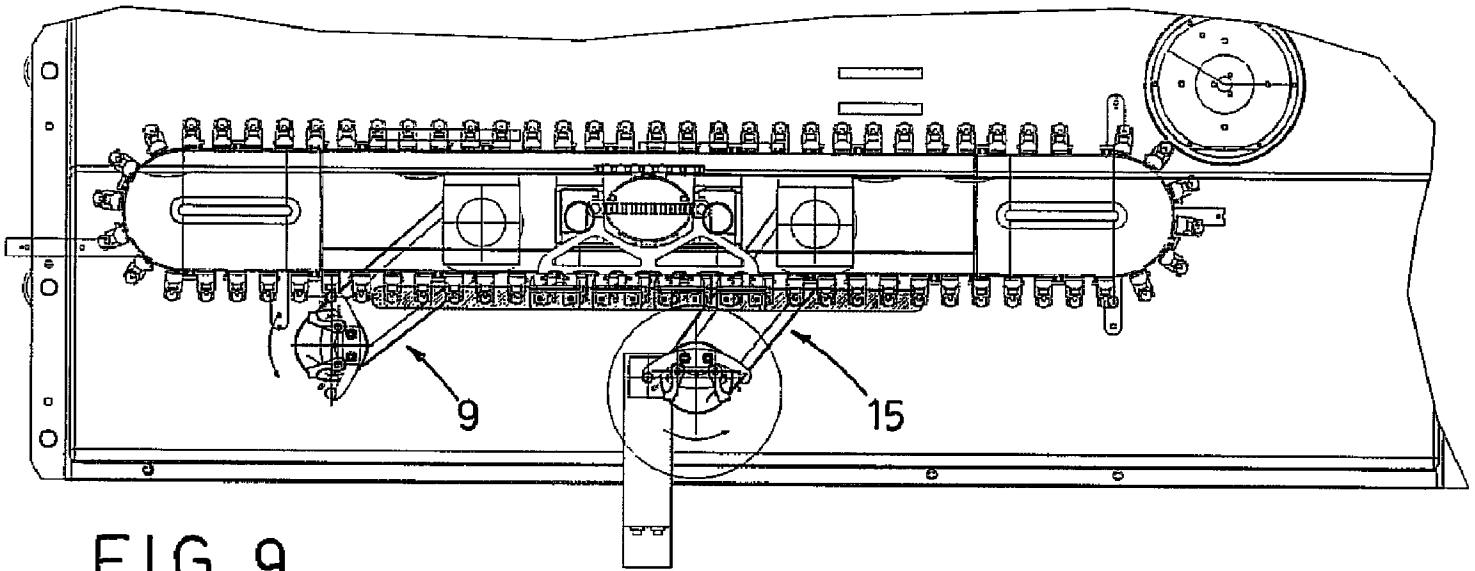
Figure 9A:
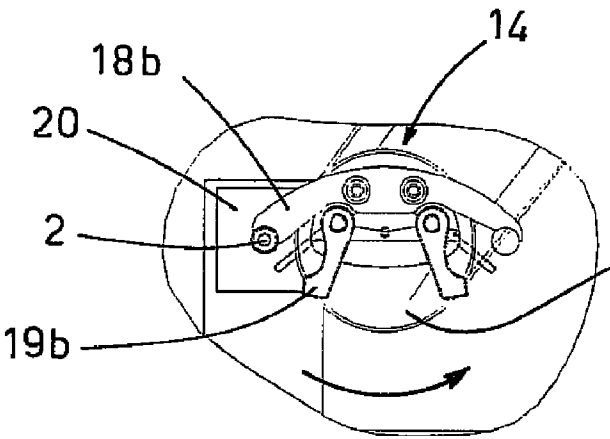
Figure 10:
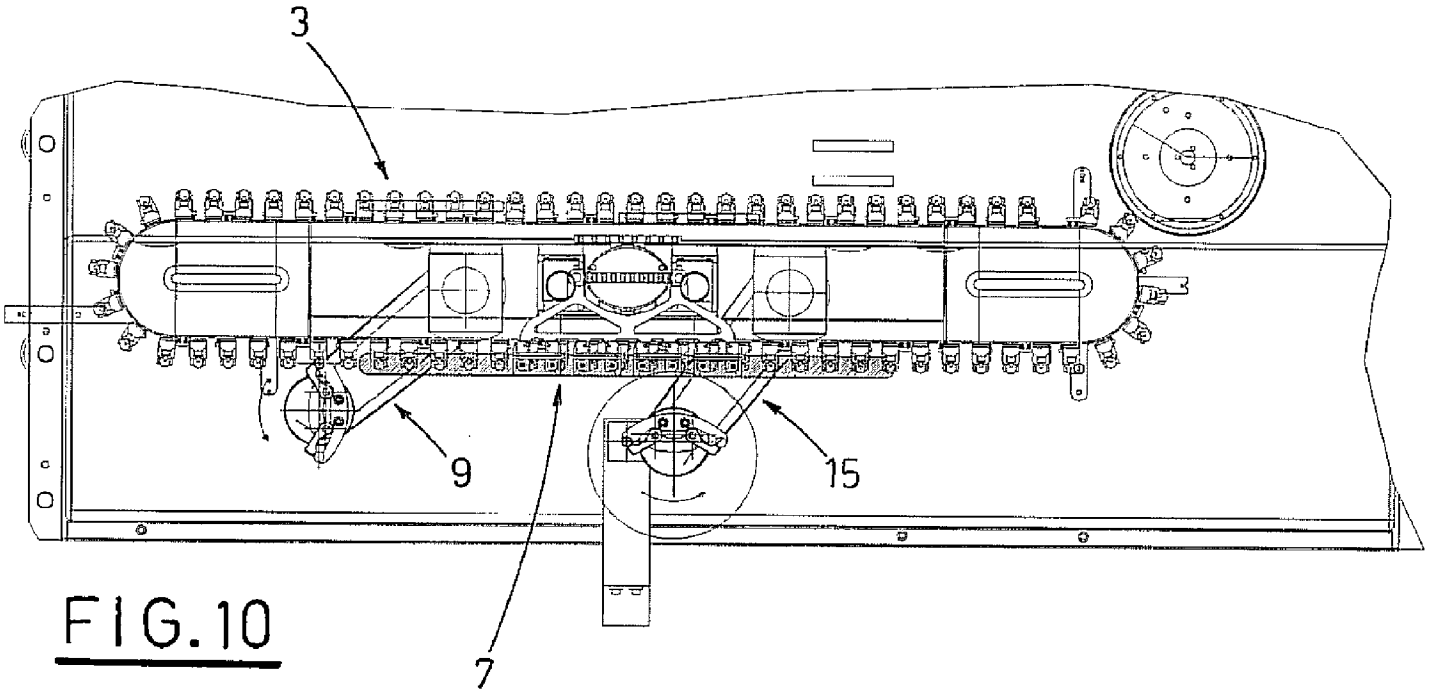
Figure 10A:
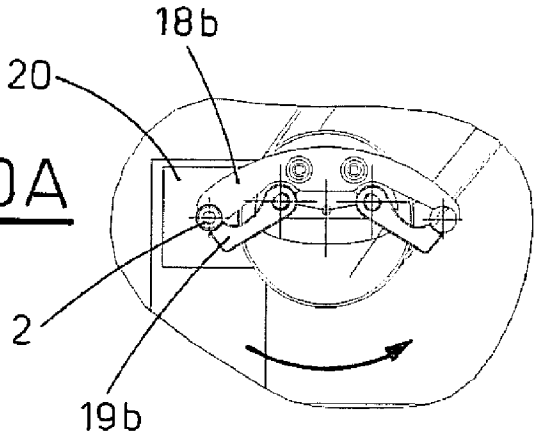

During the weighing operation, the second rotating head 14 in turn performs a rotation of 180°, in the direction indicated by the arrow C, in order to prepare the prongs 18*b*, 19*b* of the fourth pincer-like gripping organ 32*b* to pick up the weighed container 2 (FIGS. 9, 9A). The subsequent closing of the mobile prong 18*b* of the fourth pincer-like gripping organ 32*b* results in the weighed container 2 being grasped, so that it can be picked up once more from the scales 20 (FIGS. 10, 10A); at the same time the mobile prong 18*a* of the third pincer-like gripping organ 32*a* is also closed.

Figure 11:
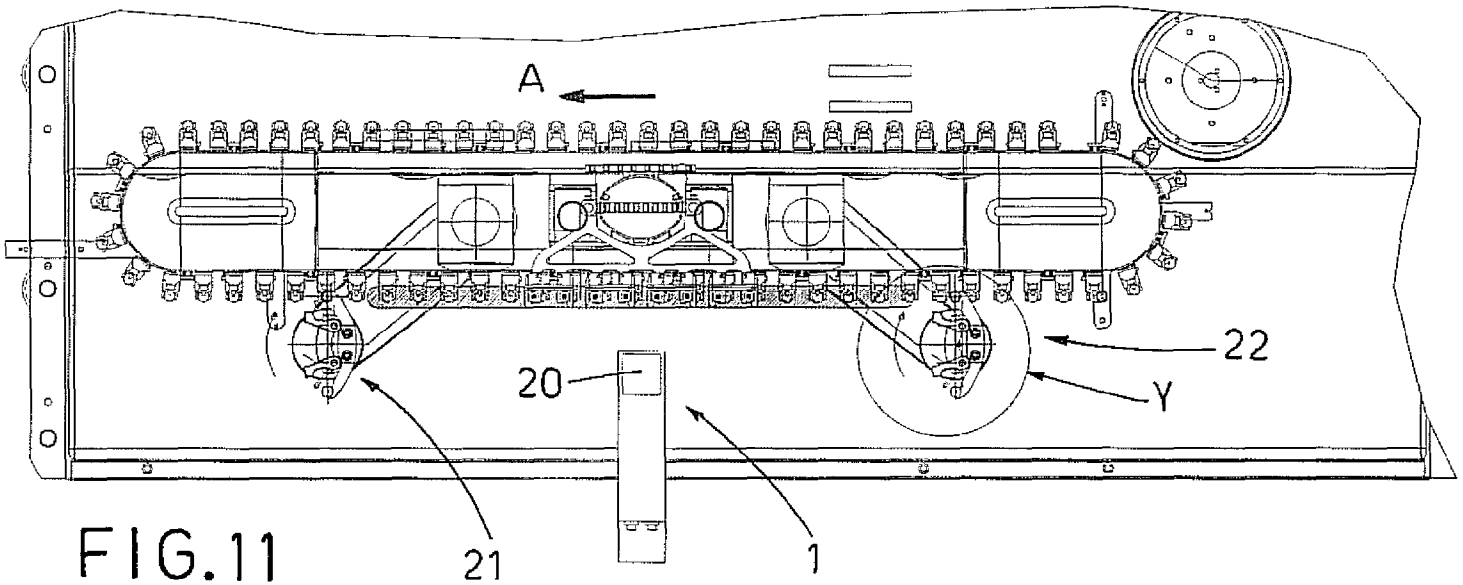
Figure 11A:
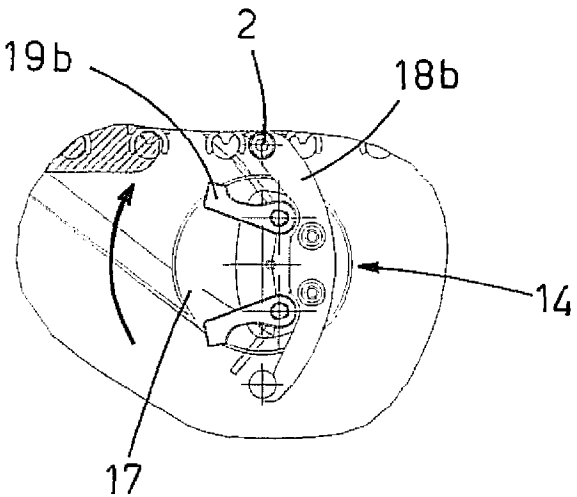

Finally, the second oscillating arm 15 is returned to the starting position, at the transport line, while at the same time the second rotating head 14 performs an angular rotation in direction B in order to reinsert the container into the free and ready support 5 (FIGS. 11, 11A).

Obviously also in this case the rotation by an angle of 180° of the rotating head 8 has the effect of inverting the orientation of the concavity of the arc-shaped element 11 relative to the direction of advancement of the vials 2, in such a way as to determine optimal interaction of the pincer-like gripping organ with the transport line both when picking up the container 2, and when relocating the container 2 in the empty support organ 5.

The weighing station described achieves the aim of optimally performing statistical weighing of the containers in lines for filling the containers with dosed quantities of liquid or powder products.

This result is due in the first place to the fact that one single weighing organ is provided to measure both the tare and gross weight of the containers. In addition to being an obvious constructional simplification, this entails greater measuring accuracy, because there is less propagation of errors.

Note further that the weighing station of the invention exhibits a structure which is constructionally and functionally simple and effective, based substantially on simple angular rotation movements which can be activated by conventional motor organs. Coordination of these angular rotation movements makes it possible to avoid down-times and does not interfere in any way with the normal advancement of the transport line.

In particular the transferring organs which pick up the containers upstream and downstream of the dosing and filling zone are independent of each other and do not interfere with each other's operating stages, even though the weighing operations are performed by one single set of scales. Further, containers are picked up in such a way that damage to the containers is avoided, thus further ensuring the continuity of functioning of the line.

A further feature of the weighing station described is that it is easy to apply to prior art vial filling lines and requires no expensive and complex structural modifications.

The above description is a non-limiting example, and any constructional variants are intended to fall within the ambit of protection of the present technical solution as described herein above, and as set out in the following claims.

What is claimed:

1. A station for weighing containers provided in an apparatus for filling containers, which apparatus comprises a transport line of the containers to be filled with a predetermined product, and a dosing and filling zone for dosing and filling the containers with the product along the transport line, the station being characterized in that it comprises one single organ for weighing the containers which are arranged in proximity of the transport line; a first transferring organ for picking up an individual empty container from the line, for transferring the container to the weighing organ and, after weighing the container, returning the container to the line; a second transferring organ, which is activated in a phase relation with activation of the first transferring organ to pick up a filled container downstream of the dosing and filling zone of the containers, a tare weight of the container having been determined previously by a combined action of the first transferring organ and the weighing organ, and transfer the container to the weighing organ and, after weighing the container, relocate the container on the line, the transferring organs respectively comprising an oscillating arm which can be activated with alternated motion between a pick-up position and a release position of the container to be weighed at the transport line, and a position for releasing and picking up the container at the weighing organ; a rotating head which is borne at the free end of the oscillating arm and which is angularly rotated by a relative motor organ, in a suitable phase relation with the motion of the oscillating arm; gripping organs which are borne by the rotating head and grasp the container to be weighed in order to transfer the container from the transport line to the weighing organ and vice versa, the transferring organs comprising a first oscillating arm arranged upstream of the zone for dosing and filling the containers and a second oscillating arm arranged downstream of the zone for dosing and filling the containers, which oscillating arms are angularly rotatable in a horizontal plane for moving the respective rotating head provided with the gripping organs alternatively from a position adjacent to the transport line to a position adjacent to the weighing organ, the gripping organs respectively comprising an arc-shaped element, solidly constrained to the rotating head and exhibiting at opposite ends thereof to a pair of fixed prongs, which cooperate with corresponding mobile prongs hinged to the rotating head.

2. The weighing station of claim 1, characterized in that the fixed prongs of the gripping organs project externally from the rotating head.

3. The weighing station of claim 2, characterized in that the mobile prongs of the gripping organs are arranged in a disengaged position contained substantially within peripheral dimensions of the rotating head when the gripping organs are opened.

4. The weighing station of claim 1, characterized in that the rotating head comprises a disc-shaped support which is rotatably constrained to the oscillating arm about a vertical axis, the disc-shaped support being angularly rotated by a suitable motor.

5. The weighing station of claim 1, characterized in that the rotating head can be angularly rotated in alternate directions by an angle of 180°, in a suitable phase relation with the movement of the rotating head itself from a position adjacent to the transport line to a position adjacent to the weighing organ.

6. A station for weighing containers provided in an apparatus for filling containers, which apparatus comprises a transport line of the containers to be filled with a predetermined product, and a dosing and filling zone for dosing and filling the containers with the product along the transport line, the station being characterized in that it comprises one single organ for weighing the containers which are arranged in proximity of the transport line; a first transferring organ for picking up an individual empty container from the line, for transferring the container to the weighing organ and, after weighing the container, returning the container to the line; a second transferring organ, which is activated in a phase relation with activation of the first transferring organ to pick up a filled container downstream of the dosing and filling zone of the containers, a tare weight of the container having been determined previously by a combined action of the first transferring organ and the weighing organ, and transfer the container to the weighing organ and, after weighing the container, relocate the container on the line, the transferring organs respectively comprising an oscillating arm which can be activated with alternated motion between a pick-up position and a release position of the container to be weighed at the transport line, and a position for releasing and picking up the container at the weighing organ; a rotating head which is borne at the free end of the oscillating arm and which is angularly rotated by a relative motor organ, in a suitable phase relation with the motion of the oscillating arm; gripping organs which are borne by the rotating head and grasp the container to be weighed in order to transfer the container from the transport line to the weighing organ and vice versa, the rotating head can be angularly rotated in alternate directions by an angle of 180°, in a suitable phase relation with the movement of the rotating head itself from a position adjacent to the transport line to a position adjacent to the weighing organ, the rotating head being angularly rotated by an angle of 180° in the position adjacent to the weighing organ in order to shift the gripping organs from a release position by a first pair of prongs of the container to be weighed, to a pick-up position of the weighed container by a second pair of prongs exhibited by the gripping organs.

7. The weighing station of claim 6, characterized in that the angular rotation of the gripping organ is performed during the weighing of the container.

8. The weighing station of claim 6, characterized in that the angular rotation of the gripping organs inverts an orientation of a concavity of an arc-shaped element exhibiting at opposite ends thereof a pair of fixed prongs of the gripping organs, with respect to the direction of advancement of the containers, in such a way that while container to be weighed is being picked up, the gripping organs are so positioned that the arc-shaped concavity of the element faces in the advancement direction of the containers while in the stage of repositioning the weighed container the arc-shaped concavity of the element faces in an opposite direction to the advancement direction of the containers.

9. A device for transferring containers, which is provided in a station for weighing containers and cooperates with a transport line of the containers to be filled with a predetermined product, a dosing and filling zone of the containers with the product along the transport line, a weighing organ of the containers arranged in proximity of the transport line, the device being characterized in that it comprises an oscillating arm which can be activated with alternating motion between a pick-up position and a release position of the container to be weighed at the transport line and a release position and a pick-up position at the weighing organ; a rotating head borne at a free end of the oscillating arm, which rotating head can be angularly rotated by a relative motor organ, in a suitable phase relation with the motion of the oscillating arm; gripping organs borne by the rotating head which grasp the container to be weighed in order to transfer the container from the transport line to the weighing organ and vice versa, the gripping organs respectively comprising an arc-shaped element, solidly constrained to the rotating head and exhibiting at opposite ends a pair of fixed prongs which cooperate with the corresponding mobile prongs hinged to the rotating head.

10. The device of claim 9, characterized in that the fixed prongs of the gripping organs project externally of the rotating head.

11. The device of claim 10, characterized in that when the gripping organs are opened the mobile prongs of the gripping organs assume a position of disengagement contained substantially within peripheral dimensions of the rotating head.

12. The device of claim 9, characterized in that the rotating head comprises a disc-shaped support which is rotatably constrained to the oscillating arm about a vertical axis and which is angularly rotated by a suitable motor.

13. The device of claim 9, characterized in that the rotating head can be angularly rotated in alternating directions by an angle of 180°, in a suitable phase relation with movement of the rotating head from a position adjacent to the transport line to a position adjacent to the weighing organ.

14. A device for transferring containers, which is provided in a station for weighing containers and cooperates with a transport line of the containers to be filled with a predetermined product, a dosing and filling zone of the containers with the product along the transport line, a weighing organ of the containers arranged in proximity of the transport line, the device being characterized in that it comprises an oscillating arm which can be activated with alternating motion between a pick-up position and a release position of the container to be weighed at the transport line and a release position and a pick-up position at the weighing organ; a rotating head borne at a free end of the oscillating arm, which rotating head can be angularly rotated by a relative motor organ, in a suitable phase relation with the motion of the oscillating arm; gripping organs borne by the rotating head which grasp the container to be weighed in order to transfer the container from the transport line to the weighing organ and vice versa, the rotating head being angularly rotated in alternating directions by an angle of 180°, in a suitable phase relation with movement of the rotating head from a position adjacent to the transport line to a position adjacent to the weighing organ, the rotating head being angularly rotated by an angle of 180° in proximity of the position adjacent to the weighing organ in order to move the gripping organs from a position of release of the container to be weighed by a first pair of prongs to a pick-up position of the weighed container by a second pair of prongs exhibited by the gripping organs.

* * * * *

UNITED STATES PATENT AND TRADEMARK OFFICE

CERTIFICATE OF CORRECTION

PATENT NO. : 8,016,538 B2
APPLICATION NO. : 12/110382
DATED : September 13, 2011
INVENTOR(S) : Giuseppe Monti It is certified that error appears in the above-identified patent and that said Letters Patent is hereby corrected as shown below:

On the title page, item (73) should read:
ASSIGNEE: Marchesini Group S.p.A.

Signed and Sealed this
Twenty-first Day of February, 2012

David J. Kappos

David J. Kappos
*Director of the United States Patent and Trademark Office*